United States Patent [19]

Mukai et al.

[11] Patent Number: 4,745,429

[45] Date of Patent: May 17, 1988

[54] DEVELOPING APPARATUS FOR AN ELECTROSTATIC PHOTOCOPIER

[75] Inventors: Hideo Mukai, Yokohama; Sachiko Yasuda, Tokyo; Minoru Yoshida, Machida; Tomoyuji Asada, Yokohama, all of Japan

[73] Assignee: Kabushiki Kaisha Toshiba, Kawasaki, Japan

[21] Appl. No.: 66,110

[22] Filed: Jun. 25, 1987

[30] Foreign Application Priority Data

Sep. 30, 1986 [JP] Japan ..... 61-231784
Nov. 12, 1986 [JP] Japan ..... 61-172695

[51] Int. Cl.[4] ..... G03G 15/06

[52] U.S. Cl. ..... 355/3 DD; 118/656; 118/261

[58] Field of Search ..... 355/3 DD, 14 D; 118/651, 653, 656, 261

[56] References Cited

U.S. PATENT DOCUMENTS 4,632,535 12/1986 Negata ..... 355/3 DD
4,688,923 8/1987 Kohyama ..... 355/3 DD

*Primary Examiner*—R. L. Moses
*Attorney, Agent, or Firm*—Oblon, Fisher, Spivak, McClelland & Maier

[57] ABSTRACT

In a developing apparatus for developing an electrostaticlatent image by applying a charged developer to the electrostatic-latent image formed on a surface of an image carrier, a housing which stores the developer and has a developing roller for feeding the developer therefrom to a developing position. A recovering blade for recovering a residual developer on the developer roller in the housing is urged against developer roller. The recovering blade has a conductive portion in contact with the developing roller so as not to non-uniformly or abnormaly triboelectrically charge a developer passing over it into the housing.

6 Claims, 2 Drawing Sheets

DEVELOPING APPARATUS FOR AN ELECTROSTATIC PHOTOCOPIER

BACKGROUND OF THE INVENTION

1. Field of the Invention

The present invention relates to a developing apparatus for an electrostatic photocopier, for applying a developer to an electrostatic latent image formed on an image carrier to develop the latent image.

2. Background of the Related Art

One-component developers or two-component developers are used in a developing apparatus of this type. A two-component developer includes a toner contributing to development and a carrier for properly charging the toner. However, in such a two-component developer, a mixing ratio of the toner to the carrier, i.e., toner concentration, must be kept constant. However, it is difficult to maintain such a constant toner concentration. On the other hand, a one-component developer has an advantage in that the concentration control is not necessary since the toner for contributing to development is the only component of the developer.

One-component developers are classified into magnetic and nonmagnetic developers. Magnetic developers use magnetic materials together with nonmagnetic materials to form the developer particles. When such a magnetic developer is used in a conventional apparatus, a magnet is arranged inside a developer carrier for carrying the developer to the developing position and generating a magnetic field for supporting and carrying the developer. However, the following problems occur when the magnetic developer is used.

First, the developer carrier becomes complicated, expensive and large in size since the magnet must be supported by the developer carrier. Second a magnetic developer containing magnetic particles is more expensive than a nonmagnetic developer. Finally, since the magnetic particles do not contribute to development, color reproducibility is not satisfactory. As a result, it is difficult to perform color developing using a magnetic developer.

In order to solve the above problems, a developing apparatus using a nonmagnetic one-component developer has been used, as disclosed in the U.S. Pat. No. 4,521,098 to Hosoya et al. In Hosoya et al, a thin film layer of toner, as a nonmagnetic one-component developer which is formed on a developing roller, is pressed by only one blade, and the toner is triboelectrically charged by the blade. Thereafter, the toner is supplied to a photosensitive body on which a latent image is formed.

With the conventional developing apparatus as described above, the toner is supported on the developing roller only by triboelectrical forces therebetween. When all the toner particles are not sufficiently charged, the toner which is not contributing to development and remains on the developing roller is removed in the housing of the developing apparatus. Thus, fogging or scattering of the toner particles occurs, and a clear image may not be obtained.

To solve the above problems, a recovery blade which is urged against the developing roller has been used in the conventional developing apparatus. In this case, the residual toner on the developing roller may be recovered in the housing without fogging or scattering. However, since the recovery blade is made of an insulator, residual toner passing over the recovery blade into the housing is non-uniformly or abnormally charged by the friction therebetween. Then, the toner is non-uniformly attached to the developing roller, and forms patterns such as stripes. Therefore, a uniform thin film toner layer may not be formed on the developing roller by the above blade, so that a latent image on the image carrier may not be sufficiently developed.

SUMMARY OF THE INVENTION

Accordingly it is an object of the present invention to provide a developing apparatus for an electrostatic photocopier which may reliably recover a residual toner.

It is a further object of the present invention to provide a developing apparatus for an electrostatic photocopier which can prevent a recovered toner in a housing from non-uniformly attaching to a developing roller.

It is still a further object of the present invention to provide a developing apparatus for an electrostatic photocopier which can produce a clear image.

It is still a further object of the present invention to provide a developing apparatus for an electrostatic photocopier which can form a uniformly thin layer of toner on a developing roller for sufficiently developing a latent image on an image carrier.

In accordance with the present invention, the foregoing objects, among others, are achieved by providing a developing apparatus for an electrostatic photocopier having an image carrier with an electrostatic latent image on a photosensitive surface thereof, in which the developing apparatus includes a housing for containing an electrically chargeable developer, means for electrically charging the developer, means for carrying the charged developer to a developing position exterior to the housing, whereby a portion of the charged developer may develop a latent image, and means for recovering a residual charged developer on the developer carrying means, while maintaining a uniform charge on the residual developer. The recovering means comprises means having a conductive portion urged against the developer carrying means. The recovering means can include a conductive member or an elastic plate including an insulative layer and a conductive layer supported on the insulative layer, wherein the conductive layer is in contact with the developer carrying means.

In accordance with another aspect of the invention, a developing apparatus in an electrostatic copier having an image carrier with an electrostatic latent image on a photosensitive surface thereof, includes means for developing the latent image on the image carrier, means for forming a thin layer on an electrically charged one-component developer on the developing means, and means for recovering the developer from the developing means while maintaining a uniform charge on the developer. The recovering means may take the form of a conductive portion urged against the developing means.

BRIEF DESCRIPTION OF THE DRAWINGS

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

A developing apparatus according to a preferred embodiment of the present invention will be described with reference to FIGS. 1 to 4.

Figure 1:
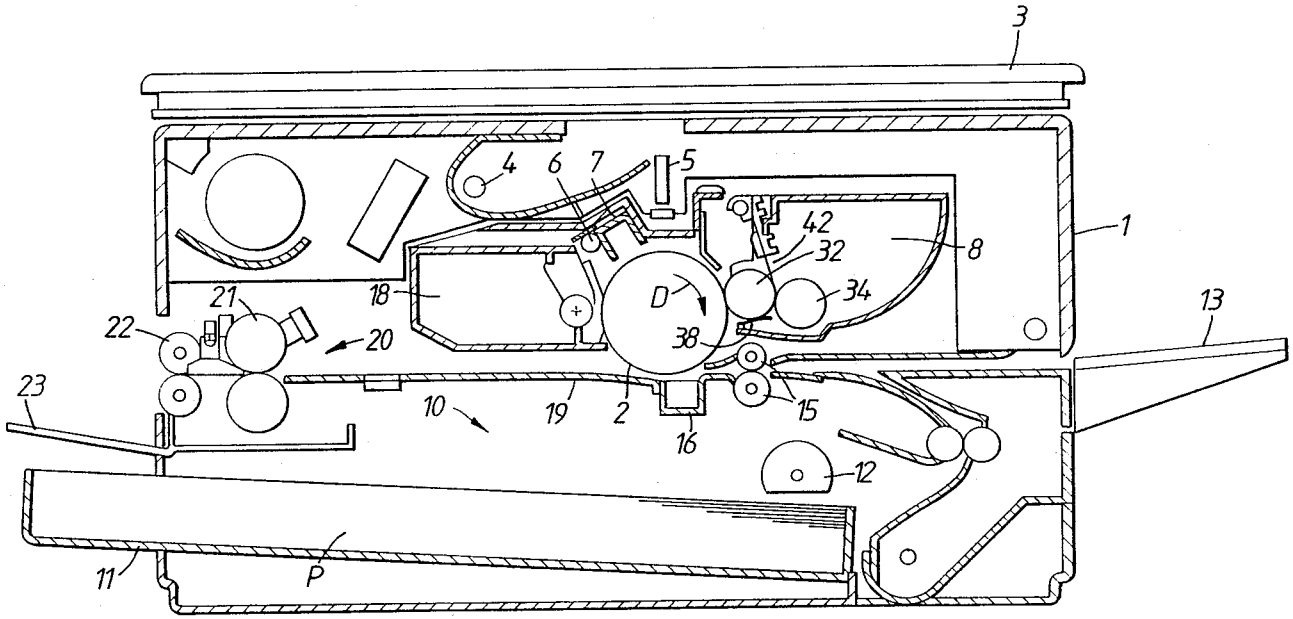
FIG. 1 is a schematic sectional view of a copying machine using a developing apparatus according to an embodiment of the present invention.

An electrostatic copying machine to which the developing apparatus according to the present invention may be applied will be described. FIG. 1 is a schematic sectional view of the copying machine. Referring to FIG. 1, refrence numeral 1 denotes a copying machine housing. Photosensitive drum 2, having a photosensitive film such as a selenium film thereon, is mounted for rotation in the direction indicated by arrow D, at substantially the center of housing 1. An electrostatic latent image is formed on the surface of photosensitive drum 2 as an image carrier. Lamp 4 and converging optical transmission member 5, which optically scan a document placed on reciprocally driven document table 3, focus a document image on a surface portion of the photosensitive drum 2 and form a latent image on the surface portion. Arranged around photosensitive drum 2 are discharge lamp 6 for uniformly discharging residual charges on the surface of photosensitive drum 2 before the document image is focused thereon, charger 7 for uniformly charging the surface of photosensitive drum 2 after the surface of photosensitive drum 2 is uniformly discharged, and developing apparatus 8 according to the present invention for applying the developer to the latent image formed on the surface of the photosensitive drum and for making the latent image visible. A visible image is formed by developing apparatus 8 on photosensitive drum 2.

A paper feeding section is arranged at both sides of housing 1. The paper feeding section comprises paper cassette 11 detachably mounted at one side of the copying machine, and paper feeding rollers 12, brought into rolling contact with the uppermost sheet P so as to feed this sheet P to the inside of housing 1. Manual feeding guide 13, for manually guiding a sheet, is arranged at the other side of the copying machine. The sheet fed from the paper feeding section is registered by register rollers 15 and is fed to a transfer portion of photosensitive drum 2 while the sheet is brought into slidable contact with the transfer portion.

Transfer charger 16 for transferring the visible image onto sheet P is arranged around photosensitive drum 2. The transfer portion referred to above is defined between photosensitive drum 2 and transfer charger 16. The sheet having the toner image (visible image) thereon is guided by conveyor belt 19 to fixing unit 20. The developer on the sheet is fixed by pressure and heated by a pair of heat rollers 21 constituting fixing unit 20. The sheet having the fixed image is discharged by a pair of discharge rollers 22 onto tray 23. The residual toner remaining on the surface of photosensitive drum 2 after the transfer operation can be removed by cleaning unit 18.

In this case, in a condition for forming images, the surface potential of photosensitive drum 2 is −600 V, a gap between photosensitive drum 2 and developing roller 32 is 250 um, and a developing bias is a superimposed voltage of an AC voltage P-P of 2.0 kV at a frequency of about 3 kHz and a DC voltage of 200 V provided by power source 51.

Figure 2:
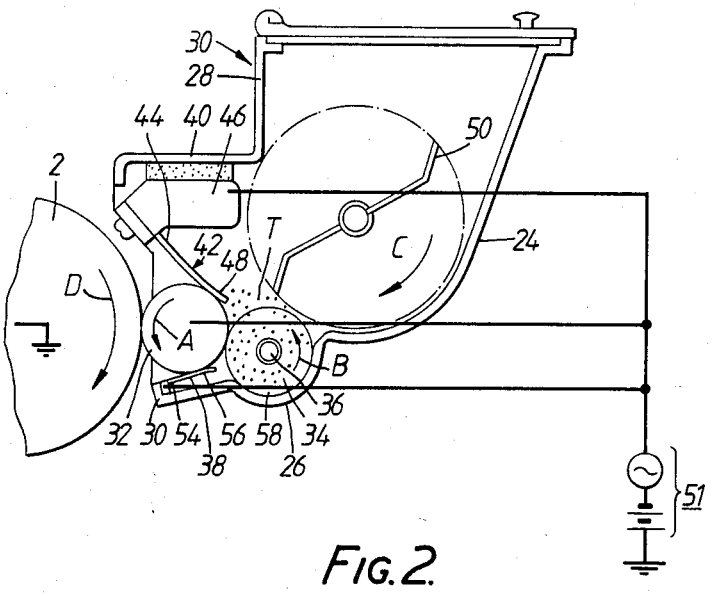
FIG. 2 is a schematic sectional view of the developing apparatus shown in FIG. 1.
Figure 3:
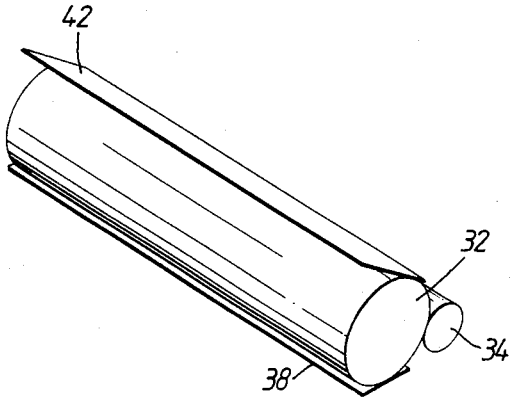
FIG. 3 is a perspective view of the developing apparatus shown in FIG. 2.
Figure 4:
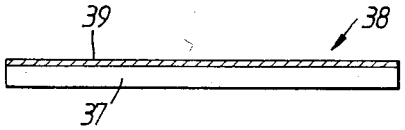
FIG. 4 is a sectional view of a recovery blade shown in FIG. 2.

Developing apparatus 8 will now be descrived with reference to FIG. 2 to 4. Developing apparatus 8 comprises housing 30 constituted by back frame 24, bottom frame 26, and front frame 28. Housing 30 stores nonmagnetic developer T. In housing 30, developing roller 32, for conveying the developer in housing 30 toward photosensitive drum 2 on which a latent image is formed, is interposed between bottom frame 26 and front frame 28. Developing roller 32 is arranged adjacent to photosensitive drum 2, and is rotatable in a direction indicated by arrow A in FIG. 2 in synchronization with rotation of drum 2. Therefore, a portion of developing roller 32 is located inside housing 30 and in contact with developer T, and another portion on the side of drum 2 is exposed to the outside between bottom frame 26 and front frame 28.

Developing roller 32 is formed by subjecting an aluminum sleeve to sandblasting, and forming a nickel electroplated layer thereon. A surface roughness after plating is about 1 μm.

Developer supplying roller 34 for supplying developer T to developing roller 32 while charging developer T is arranged adjacent to bottom frame 26 in housing 30. Roller 34 is rotatable in a direction indicated by arrow B in FIG. 2 and is in contact with roller 32.

Developer supplying roller 34 is constituted by a metal shaft 36 having conductive rubber 58 coated thereon. As the conductive rubber material, a material prepared by mixing carbon or metal powder in neoprene rubber is used. In this case, conductive urethane can be used in place of the conductive rubber material.

The proximal end portion 44 of elastic blade 42 for forming a thin film layer of developer on developing roller 32 and charging it is mounted on the lower end portion 40 of front frame 28 via member 46. The free end portion 48 of elastic blade 42 is urged against developing roller 32 at a position above a contacting point between rollers 34 and 32.

Stirring plate 50 for stirring the developer inside housing 30 is rotatable in a direction indicated by arrow C in FIG. 2 and is arranged at substantially the center of housing 30.

A proximal end portion 54 of recovering blade 38 for recovering a residual developer on developing roller 32 after development is mounted on upper end portion 30 of bottom frame 26. A free end portion 56 of recovering a blade 38 is urged against developing roller 32 at a position under an opposing point between roller 32 and photosensitive drum 2. Recovering blade 38 has an elastic plate including a first layer 37 and a second layer 39 supported on first layer 37. First layer 37 is made of an insulation material such as a polyester film. Second layer 39 is made of conductive material such as aluminum foil. The elastic plate has a thickness ranging from about 100 to 150 μm. Preferably, the elastic plate is formed by laminating the aluminum foil onto the polyester film. Second layer 39 is in contact with developing roller 32.

The superimposed voltage power source 51 is connected to developing roller 32, elastic blade 42 and recovering blade 38. On the other hand, a base drum of photosensitive drum 2 and the developer supplying roller 34 are grounded.

The operation of this embodiment will now be described with reference to FIG. 2. In this case, a nonmagnetic developer (toner) which has a positive charging property is used.

Stirring plate 50 is rotated in a direction indicated by arrow C. Toner in the housing 30 is stirred and is moved toward the developer supplying roller 34 upon rotation of plate 50.

Developer supplying roller 34 is rotated in a direction opposite to arrow A at a contacting point with developing roller 32. Roller 34 moves toner therearound by a frictional force on its outer peripheral surface, so as to triboelectrically charge the toner particles. In this case, the toner is charged to be positive (+). Roller 34 is grounded, and so has a relatively negative (−) charge. Therefore, the toner becomes attached to roller 34 by an electrostatic force, and is moved upon rotation of roller 34. Since the attached toner particles are moved with the roller 34 upon rotation of roller 34, they can be sufficiently triboelectrically charged together with the surrounding toner particles.

The toner particles which become attached to roller 34 and are sufficiently charged are rubbed onto roller 32 at the contacting point between rollers 34 and 32. Upon this rubbing, the toner becomes attached to roller 32.

The toner attached to roller 32 is pressed by blade 42 and is further triboelectrically charged, thus forming a uniform thin layer.

Roller 32 is rotated in the direction indicated by arrow A and conveys the toner layer to a position facing photosensitive drum 2. A developing bias is established between roller 32 and drum 2 by power source 51, so that the toner particles attached to roller 32 fly to drum 2, thus developing a latent image formed thereon.

The residual toner which is not subjected to development remains on the outer peripheral surface of roller 32. However, the residual toner is further conveyed upon rotation of roller 32, and is recovered in housing 30 by recovering blade 32 without fogging or scattering. As the residual toner passes over recovering blade 38 into housing 30, the residual toner is rubbed by second layer 39 of recovering blade 38 during rotation of developing roller 32. Since second layer 39 of recovering blade 38 is made of a conductive material, the residual toner is not non-uniformly or abnormaly charged by the friction therebetween. Therefore, the residual toner is uniformly attached to developing roller 32 by a triboelectrical charge and is further conveyed toward developer supplying roller 34 upon further rotation of developing roller 32.

Developing roller 32 is then supplied with new, sufficiently charged, toner by developer supplying roller 34 and is further rotated to develop a latent image formed on photosensitive drum 2 as described above.

The present invention is not limited to the above embodiment, and various other changes and modifications may be made within the spirit and scope of the invention.

What is claimed as new and desired to be secured by Letters Patent of the United States is:

1. A developing apparatus for an electrostatic photocopier having an image carrier with an electrostatic latent image on a photosensitive surface thereof, comprising:

a housing for containing an electrically chargeable developer;

means for electrically charging said developer;

means for carrying the charged developer to a developing position exterior to said housing, whereby a portion of said charged developer may develop a latent image; and means for recovering a residual charged developer on said developer carrying means while maintaining a uniform charge on said residual developer, said recovering means comprising means having a conductive portion urged against said developer carrying means.

2. The apparatus according to claim 1, wherein said recovering means includes a conductive member.

3. The apparatus according to claim 1, wherein said recovering means comprises an elastic plate including an insulating layer and a conductive layer supported on said insulating layer, wherein said conductive layer is in contact with said developer carrying means.

4. The apparatus according to claim 1, wherein said developer supplying means comprises a roller positioned in said housing and capable of carrying the developer on an outer peripheral surface thereof.

5. The apparatus according to claim 1, wherein said developer supplying means has a conductive member formed of conductive rubber material.

6. A developing apparatus in an electrostatic copier having an image carrier with an electrostatic latent image on a photosensitive surface thereof, comprising:

means for developing the latent image on said image carrier;

means for forming a thin layer of an electrically charged one-component developer on said developing means; and means for recovering said developer from said developing means while maintaining a uniform charge on said developer, said recovering means comprising means having a conductive portion urged against said developing means.

* * * * *

UNITED STATES PATENT AND TRADEMARK OFFICE

CERTIFICATE OF CORRECTION

PATENT NO. : 4,745,429

DATED : May 17, 1988

INVENTOR(S) : Hideo Mukai, et al.

It is certified that error appears in the above-identified patent and that said Letters Patent is hereby corrected as shown below:

On the Title Page, Item [75]

The spelling of the name of the fourth inventor should be corrected as follows:

-- Tomoyuki Asada --

Item [30]

Under Foreign Application Priority Data, the second entry should be omitted. Priority is claimed on Japanese application No. 61-231784 only.

Signed and Sealed this

Twentieth Day of September, 1988

*Attest:*

DONALD J. QUIGG

*Attesting Officer*

*Commissioner of Patents and Trademarks*